United States Patent [19]

Lawrence

[11] 4,091,582

[45] May 30, 1978

[54] TRUSSED ROOF STRUCTURE FOR PREFABRICATED BUILDINGS

[76] Inventor: Robert Raymond Lawrence, 205 W. 5th St., Alturas, Calif. 96101

[21] Appl. No.: 722,885

[22] Filed: Sep. 13, 1976

[51] Int. Cl.[2] ..... E04B 1/343

[52] U.S. Cl. ..... 52/79.7; 52/92; 52/143

[58] Field of Search ..... 52/79.5, 79.7, 79.8, 52/90, 92, 143

[56] References Cited

U.S. PATENT DOCUMENTS

| | | | |
|---|---|---|---|
| 2,990,588 | 7/1961 | McKinley | 52/143 |
| 3,638,373 | 2/1972 | Chapman | 52/79.5 X |
| 3,791,082 | 2/1974 | Bowling | 52/90 X |
| 3,823,522 | 7/1974 | Jureit | 52/641 |

*Primary Examiner*—Alfred C. Perham

[57] ABSTRACT

A roof truss featuring an upper chord segment at its apex which segment is not installed until final erection of prefabricated building allows "over the road" load height reduction in transport of building. Making steeper pitch roofs feasible allows use of relatively smaller truss members. A longitudinal flat member lying at right angles to trusses and attaching to tops of lower chords at midspan between panel points stiffens lower chords against ceiling deflection and also serves as an attic catwalk. Final erection installation of upper chord segment and the small portion of roofing overlying same, permits concealment of structural attachment method utilized to join two half-buildings and a finished appearance results.

1 Claim, 4 Drawing Figures

TRUSSED ROOF STRUCTURE FOR PREFABRICATED BUILDINGS

This invention has particular application to the prefabricated housing industry where economical factory prefabrication of buildings has heretofore required construction and installation of roof trusses in such a manner to permit transportation of the building "over the road" without exceeding height limit restrictions and this has resulted in almost universal use of low pitched roofs in the prefabricated building industry to date. This invention originates a roof truss which is transported as a relatively low load but when finally erected, a fairly steep pitch roof results.

A roof truss must serve two major purposes (a) support required roof loading often referred to as snow loading and (b) support required ceiling loading which is usually established by building code requirements rather than actual weight of ceiling. Particularly in relatively deep trusses structural size of the lower chord member is dictitated by ceiling load building code requirements rather than by stress induced by truss loading. Building codes have enforced ceiling load requirements because otherwise lower chord sizes as required by deep trusses would be too small to provide reasonable stiffness in the ceiling framing. As a result of the latter, lower chord members of roof trusses are often over sized because of this concern for ceiling deflection. This invention originates a lower chord stiffener (and catwalk) which greatly increases the rigidity of ceiling framing by tieing all lower chords together at points of maximum flexure and thus requiring deflection of several adjoining lower chords before any single lower chord can deflect, under ceiling loading. Furthermore, this invention, by making deeper roof trusses more feasible, encourages marked economy in truss member design and probably also in the relm of roofing materials in that a steep pitched roof materially increases the economic life of most roofing materials.

Heretofore the structural connection of roofs of adjoining half buildings particularly in the case of mobile homes has resulted in what has been called a "top notch" projection above the roof ridge that is unsightly. Often it is attempted to keep the roof line low to conceal the top notch but the resulting shallow roof trusses have reduced strength. The relatively unsightly top notch coupled with the prevalent low profile roof line have contributed substantially to what is quite universally recognized as the "mobile home look" and it is often felt that this "look" is at least somewhat responsible for some of the prejudice against mobile homes which at least presently provide the only low cost housing available. This invention conceals the method of structural attachment of the roofs of adjoining halves and results in a finished appearance, devoid of the top notch, similar to conventional buildings.

For the purpose of illustrating the invention there is shown in the drawings a form which is presently preferred; it being understood, however, that this invention is not limited to the precise arrangements and instrumentalities shown.

Figure 1:
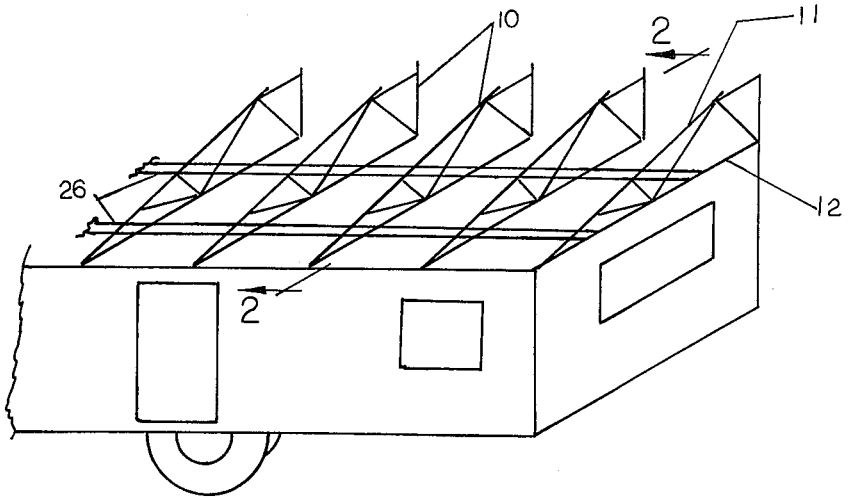
FIG. 1 is a perspective view of a trussed roof structure
Figure 2:
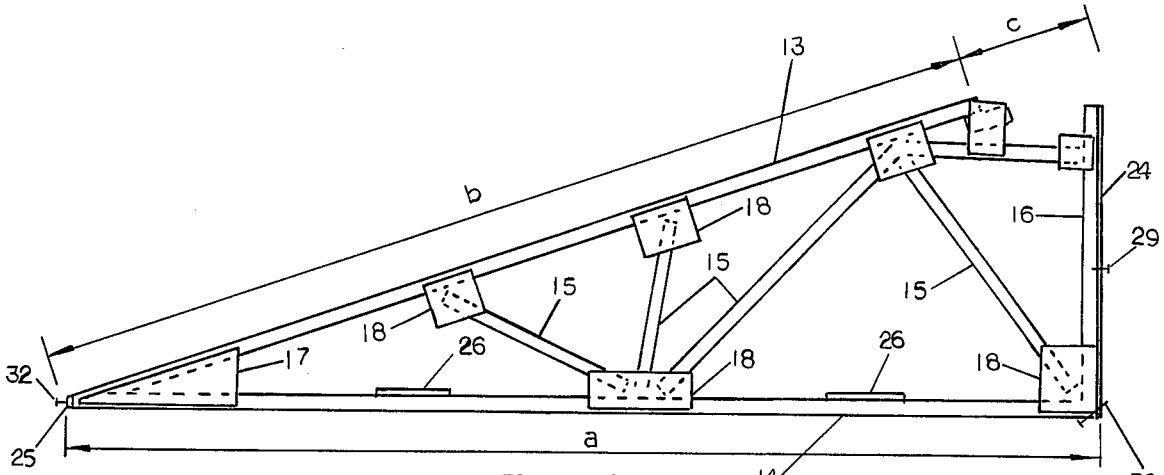
FIG. 2 is a side elevation view of a trussed roof structure
Figures 3, 4:
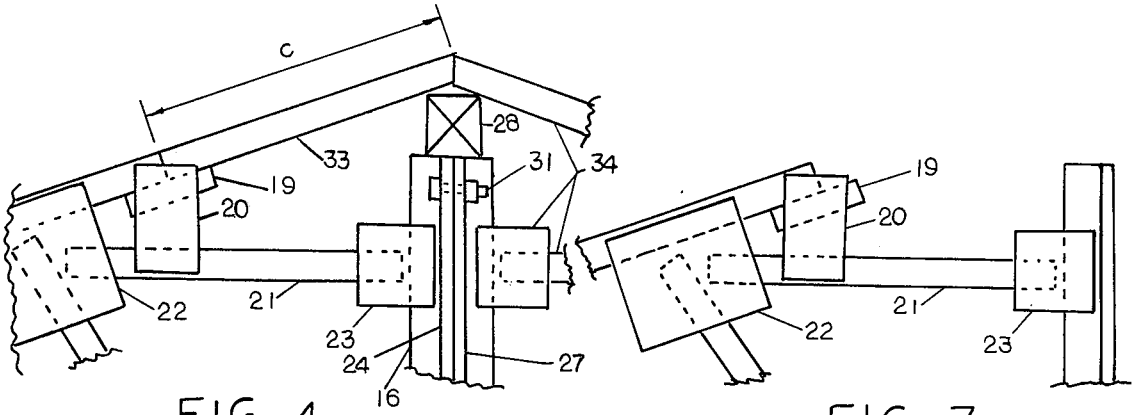

FIG. 3 is a detail of the apex of a trussed roof structure without the upper chord segment FIG. 4 is a detail of the roof ridge of two interconnected half buildings with upper chord segment in final erection position Referring to the drawings, a preferred embodiment of this invention is illustrated which, in general, includes specially designed trusses 10 for support of roof 11 and ceiling 12 of a prefabricated building. Each of the trusses 10 has an elongated upper chord 13 and a matching lower chord 14 positioned vertically below it along with several web members 15 which are connected to chord members 13 and 14 by gussets 18 by means of glue and/or mechanical fasteners such as nails, staples or screws. A heel gusset 17 connects chord members 13 and 14 at their point of intersection by means of glue or mechanical fasteners as above. At the deep end of truss 10 there is provision for a segment of upper chord 33 that can be omitted in the original fabrication of the truss and also in the assembly of the multitude of trusses in the factory. At the time of final erection of the fabricated building, this upper chord segment 33 may be installed so that it will bear upon shear block 19 at its lower end and bearing block 28 at its upper end which, incidentally, is the apex of the completed roof comprising two prefabricated building halves. Shear block 19 is supported by gusset 20 which is attached to horizontal web member 21 which, in turn, is supported at its ends by gussets 22 and 23. As a roof is constructed, trusses 10 are interconnected parallel to each other being spaced sufficiently close together laterally to provide necessary roof and ceiling load carrying capacity. Individual trusses 10 are secured in this parallel relationship by connecting end post 16 to ridge beam 24 by mechanical fasteners such as nails, staples or screws 29. At their shallow end individual trusses are connected to rim member 25 by fasteners 32 such as nails, staples or screws. Finally, installation of lower chord 14 stiffener 26, if chord reinforcement or provision of an attic catwalk is desirable, to lie perpendicular to the trusses attaching to the top of the lower chord at or near points of midspan of the lower chord 14 between panel points completes interconnection of trusses 10 in the factory permitting installation of final ceiling covering over distance "*a*" sheathing and final roof covering installation over distance "*b*" relative, that is, to trusses 10. Prior to installation of top chord segment 33 at the final erection site, connection of the roof of the prefabricated building half described above can be made to its counterpart half building 25 using connectors 31 that, in effect, connect ridge beam 16 of one half building to ridge beam 27 of the adjoining half building. Connection at the ceiling line of the two half buildings is accomplished by means of toe nails or screws 30 or the equivalent. Sheathing and final foof covering are installed over distance "*c*" thus concealing the interconnecton method for the building halves and providing a finished appearance.

Although a preferred embodiment of this invention has been shown and described, this invention is not meant to be limited thereto but is intended to embody all forms and modifications within the spirit of the following claims.

I claim:

1. A trussed roof structure comprising a. a longitudinally elongated wooden upper chord member.

b. a longitudinally elongated wooden lower chord member substantially equal in length to said upper chord member, c. means connecting said upper and lower chord members so that said upper chord, in final use, is spaced above said lower chord in the same vertical plane but lying at an angle with said lower chord, said means including multiple slanted wooden web members each of said web members incorporating flat gusset plates at each end, said gusset plates being constructed of one of the general class of materials characterized by plywood, hard board and particle board, said gusset plates connect said web members to said upper and lower chord members, respectively, utilizing such fasteners as glue alone, glue and staples or staples alone, said means of connecting said upper and lower chord members also includes a heel gusset plate being constructed and fastened as mentioned above for gusset plates, which connect said upper and lower chord members together at or relatively near their point of intersection, d. a longitudinally elongated wooden end post connected to said lower chord by a gusset plate, being constructed and fastened as indicated above for gusset plates, which also connects a slanted web member to said lower chord, said end post lying in same vertical plane as upper and lower chord members and intersecting said lower chord at right angles, e. means connecting trussed roof structure to prefabricated building ridge beam such that said end post lies flat or nearly flat against said ridge beam and staples, nails, or screws, with or without glue, make the connection between said ridge beam and said end post, f. a longitudinally elongated horizontal wooden web member, said member lying in the same vertical plane as said upper and lower chord members and said horizontal web member also lying at or near right angles to, and in the same vertical plane as, said end post member and connected therewith by means of a flat gusset plate, being constructed and fastened as mentioned above for gusset plates, said horizontal web member serving to assist said upper chord in support of a longitudinally elongated shear block by means of a flat gusset plate connected to said horizontal web member and also said upper chord member, said shear block serving purpose of supporting lower end of an upper chord segment, g. a longitudinally elongated wooden member constituting said upper chord segment which when finally installed lies adjacent to and is colinear with said upper chord member, of substantially shorter length than said upper chord member, and final positioning of said upper chord segment completes, in form, a right triangle figure bounded by upper chord segment, upper chord member, lower chord member, and end post member, respectively, said upper chord segment being supported at its lower end by said shear block and at its upper end by means of a bearing block resting upon the prefabricated building ridge beam, said upper chord segment allowing completion of roof sheathing and final roof covering at the final erection site thus permitting over the highway transport of a lower height load and also permitting concealment of roof interconnection method of prefabricated building halves, h. means of reinforcing said lower chord so that said lower chord will undergo less deflection under effect of contributary ceiling loading and more adequately resist flexural and axial unit stresses so induced, said means being a longitudinally elongated stiffener member lying above and at right angles to each of said lower chords of said roof trusses while in their parallel configuration, attaching to perspective lower chords at points at or near mid span of said lower chord between panel points, said means of connection being characteristically glue and/or staples, nails or screws.

* * * * *